US007846509B1

(12) United States Patent
Crouch et al.

(10) Patent No.: US 7,846,509 B1
(45) Date of Patent: Dec. 7, 2010

(54) METHOD FOR FORMING AND FINISHING A CONTINUOUS FABRIC WEB

(75) Inventors: Earl T. Crouch, Greensboro, NC (US); Joe Nicholson, Kernersville, NC (US)

(73) Assignee: Highland Industries, Inc., Kernersville, NC (US)

( * ) Notice: Subject to any disclaimer, the term of this patent is extended or adjusted under 35 U.S.C. 154(b) by 1044 days.

(21) Appl. No.: 10/872,053

(22) Filed: Jun. 18, 2004

Related U.S. Application Data

(63) Continuation of application No. 09/616,616, filed on Jul. 14, 2000, now abandoned.

(51) Int. Cl.

| | |
|---|---|
| ***D06B 1/14*** | (2006.01) |
| ***B05D 5/04*** | (2006.01) |
| ***B05D 1/28*** | (2006.01) |
| *D06B 23/00* | (2006.01) |

(52) U.S. Cl. ..... 427/412; 427/177; 427/428.06; 427/428.2

(58) Field of Classification Search ..... 427/177, 427/209, 412, 434.2, 434.3, 428.06, 428.2
See application file for complete search history.

(56) References Cited

U.S. PATENT DOCUMENTS

| | | | | |
|---|---|---|---|---|
| 3,248,904 | A * | 5/1966 | Frishman | 66/147 |
| 4,350,725 | A * | 9/1982 | Pfluger | 428/95 |
| 4,388,364 | A | 6/1983 | Sanders | 428/253 |
| 4,443,516 | A | 4/1984 | Rogers | 428/253 |
| 4,946,739 | A * | 8/1990 | Chapman et al. | 442/71 |
| 5,399,419 | A * | 3/1995 | Porter et al. | 442/35 |
| 5,895,705 | A | 4/1999 | Crouch et al. | 156/247 |
| 5,950,457 | A | 9/1999 | Wagner, Jr. et al. | 66/192 |
| 6,287,743 | B1 | 9/2001 | Oakland et al. | 430/201 |
| 2001/0051483 | A1 | 12/2001 | Callaway et al. | 442/314 |

* cited by examiner

*Primary Examiner*—William Phillip Fletcher, III
(74) *Attorney, Agent, or Firm*—MacCord Mason PLLC

(57) ABSTRACT

A printing substrate is formed in a single operation by a method of forming and finishing a fabric web. The forming step creates a continuous fabric web. That fabric is sent to an accumulator, then downstream for finishing. The finishing step includes applying a printable coating via a knurled applicator, controlling the level of liquid in the applicator and compensating for knurled roller deflection. The finishing step further includes curing the coated fabric and selectively employing VOC hoods where needed.

5 Claims, 16 Drawing Sheets

METHOD FOR FORMING AND FINISHING A CONTINUOUS FABRIC WEB

This application is a continuation of application Ser. No. 09/616,616, filed Jul. 14, 2000, now abandoned.

BACKGROUND OF THE INVENTION (1) Field of the Invention

The present invention relates generally to a printing substrate for signage and the like formed from a continuous fabric web and, more particularly, to a printing substrate formed and finished in a single operation which is substantially distortion free.

(2) Description of the Prior Art

Recent years have seen a proliferation of outdoor advertising media for such events as outdoor sporting events, concerts, celebrations, etc. As the volume of advertising has grown, so has the demand for more visible media which can be cost effectively produced quickly and with a high level of quality. Traditionally, printing substrates for such signage has been formed from woven fabrics because paper and non-woven fabrics are not strong enough for these applications. Woven fabrics can be produced as relatively large panels for use as banners and can be coated with print receptive materials that are resistant to running and fading of the printed materials. However, because of inherent problems with instability in the larger denier, high strength yarns needed and with fabric distortion created during the handling and subsequent coating of these fabrics, image quality often suffers in the form of streaking and uneven color absorption.

Knitted fabrics have heretofore not been suitable for use in outdoor signage because even higher degrees of distortion are usually introduced into a knitted fabric than a woven fabric as a result of movement and handling required to coat the knitted fabric in preparation for its intended use. However, knitted fabrics, if they could meet the required surface stability, would offer huge economic advantages over woven printing substrates. For example, warp knitting machines can produce large width continuous fabric webs at extremely high speed when compared to the speed of a loom. Fabric webs produced by warp knitting machines have many industrial applications but generally are subsequently coated with another material, such as plastic, to produce a composite material. In such cases, the fabric web acts as a substrate to give added strength and the plastic coating may be, for example, a roofing material. Because the fabric web is only used for reinforcement, distortion in the fabric web is not critical, nor is it usually seen by the end user.

While warp knitting machines having widths greater than 72 inches are common and relatively inexpensive, finishing machines having widths greater than 72 inches become exponentially expensive. In addition, the costs associated with moving such wide rolls of fabric can add substantial cost per yard to the final material. Prior art attempts to integrate the fabric forming and finishing operations into a single operation have not been very successful. Specifically, it is very difficult to control the thickness of the coating operation unless the coating operation is continuous. However, by its nature, fabric forming must be stopped and started when defects, such as broken yarns, occur.

Thus, there remains a need for a printing substrate for signage or the like formed economically from a weft inserted, warp knitted continuous fabric web while, at the same time, the fabric web can be finished in a single operation so as to be substantially distortion free for improved print quality.

SUMMARY OF THE INVENTION

The present invention is directed to a printing substrate. The printing substrate is formed from a weft inserted, warp knit fabric web finished in a single operation having at least an 8×9 construction and a print receptive coating. In the preferred embodiment, the print receptive coating is polyvinyl chloride, such as a vinyl and acrylate blend. In the most preferred embodiment, the print receptive coating is a plastisol coating. The print receptive coating may further include an opacifier, such as titanium dioxide and a flame retardant.

Also, in the preferred embodiment, the fabric web is formed and finished in a single operation. Because of this unique manufacturing method, the fabric web is substantially distortion free. Specifically, the variation in the warp direction of the finished fabric web is less than about 6%, and preferably less than about 3%. In addition, the variation in the weft direction of the finished fabric web is less than about 16%, and preferably less than about 5%.

Preferably, the finished fabric web is formed from synthetic yarn, such as polyester yarn. The finished fabric web may be manufactured in widths greater than about 72, 96 or 120 inches wide. In the preferred embodiment, the fabric web is formed with between about an 8×9 and an 18×18 construction and preferably about a 9×18 construction with at least 500 d ends.

One apparatus and method for producing the present invention is disclosed in application Ser. No. 09/479,678, filed Jan. 7, 2000, now U.S. Pat. No. 6,405,418, which is hereby incorporated by reference in its entirety. This application discloses an apparatus for forming and finishing a continuous fabric web in a single operation. The apparatus includes a fabric web forming station for forming a continuous fabric web and a finishing station downstream from the fabric web forming station for receiving the continuous fabric web from the fabric web forming station and for providing a finishing treatment to the continuous fabric web. In the preferred embodiment, the fabric web forming station is a warp knitting machine having a creel and a plurality of yarn packages for supplying yarn to the warp knitting machine.

In the preferred embodiment, the finishing station includes a substantially excess-free applicator which helps to prevent thick spots in the coated fabric web which may occur when a coating applicator is stopped and restarted. The applicator of the present invention includes a liquid coating supply; an elongated pan extending across the width of the fabric web for containing the liquid coating; and an elongated knurled roller positioned in the pan in direct contact with the liquid coating and in direct contact with the bottom surface of the fabric web, whereby the rotation of the knurled roller transfers a predetermined amount of the liquid coating to the fabric web.

The volume of the grooves in the knurled surface of the knurled roller is proportional to the predetermined amount of the liquid coating being transferred to the fabric web. The predetermined amount of the liquid coating being transferred to the fabric web is substantially equal to the desired liquid take-up of the fabric web, thereby eliminating the need for removing excess liquid take-up from the fabric web.

To further control the accuracy of the amount of liquid being transferred from the knurled roller to the continuous fabric web, the deflection of the knurled roller is minimized in several ways. First, the bulk density of the knurled roller is less than about 3 times greater than the density of the liquid coating, thereby providing buoyancy to support the weight of the knurled roller. In the preferred embodiment the knurled roller is formed substantially from aluminum; however, the knurled roller could be jacketed with a high-density outer sheath and a low-density inner core. Second, a level control maintains the amount of liquid in the elongated pan at a predetermined level. Third, a deflection compensator attached to the knurled roller.

The deflection compensator is attached to the knurled roller includes a frame located at least one end of the knurled roller, a journal extending outwardly from the knurled roller, a first bearing attached to the frame for receiving the journal, a second bearing located at the outermost end of the journal and a pneumatic cylinder linkage attached between the second bearing and the frame for providing a downward force to compensate for the deflection of the knurled roller.

In the preferred embodiment, the finishing station includes a curing station downstream from the applicator. The curing station may include both a drying station and a heat set station downstream from the drying station. In the preferred embodiment the drying station includes a heat drum having a temperature between about 180 F and 225 F to remove most of the moisture from the coated continuous fabric web but not to produce VOCs which occur during curing of the coating. Desirably, a temperature of about 212 F will optimize the amount of moisture removed from the coated continuous fabric, while minimizing shrinkage of the fabric. A hood is located above the drying station for removing moisture driven off from the fabric web by the drying station. The airflow velocity of the hood is greater than about 400 CFM/ft of the width of the continuous fabric web which aids in drying the coated continuous fabric web. However, since the vapors include little or no VOCs, this large amount of air does not need to be treated further before being discharged into the atmosphere.

In the preferred embodiment, the heat set station includes a low thermal mass heat source which quickly cools when turned off. This permits the finishing station to be stopped and started as needed without burning the coated continuous fabric web. The heat set station also includes a hood located above the heat set station for removing VOCs driven off from the fabric web by the heat set station. Unlike the drying station, the airflow velocity of the hood is less than about 100 CFM/ft of the width of the continuous fabric web. This is a much smaller amount of air to be treated before being discharged into the atmosphere and results in substantial cost savings. In the preferred embodiment, the heat set station further includes a tenter frame for heat setting the continuous fabric web to a predetermined width.

Also in the preferred embodiment of the present invention is an accumulator located between the fabric web forming station and the finishing station for providing a fabric web reserve between the fabric web forming station and the finishing station. The accumulator includes a frame extending across the width of the continuous fabric web, a pair of arms each having one end attached to the frame on opposite edges of the continuous fabric web, a biased roller attached between the other ends of the pair of rollers and extending across the width of the continuous fabric web and a control system for varying the speed of the finishing station in response to the position of the accumulator arms.

Accordingly, one aspect of the present invention is a printing substrate, said printing substrate comprising a weft inserted, warp knit fabric web having at least an 8×9 construction.

Another aspect of the present invention is a printing substrate, said printing substrate comprising a weft inserted, warp knit fabric web finished in a single operation having at least an 8×9 construction.

Still another aspect of the present invention is a printing substrate, said printing substrate comprising a weft inserted, warp knit fabric web finished in a single operation having at least an 8×9 construction; and a print receptive coating.

These and other aspects of the present invention will become apparent to those skilled in the art after a reading of the following description of the preferred embodiment when considered with the drawings.

DESCRIPTION OF THE PREFERRED EMBODIMENTS

Figure 1:
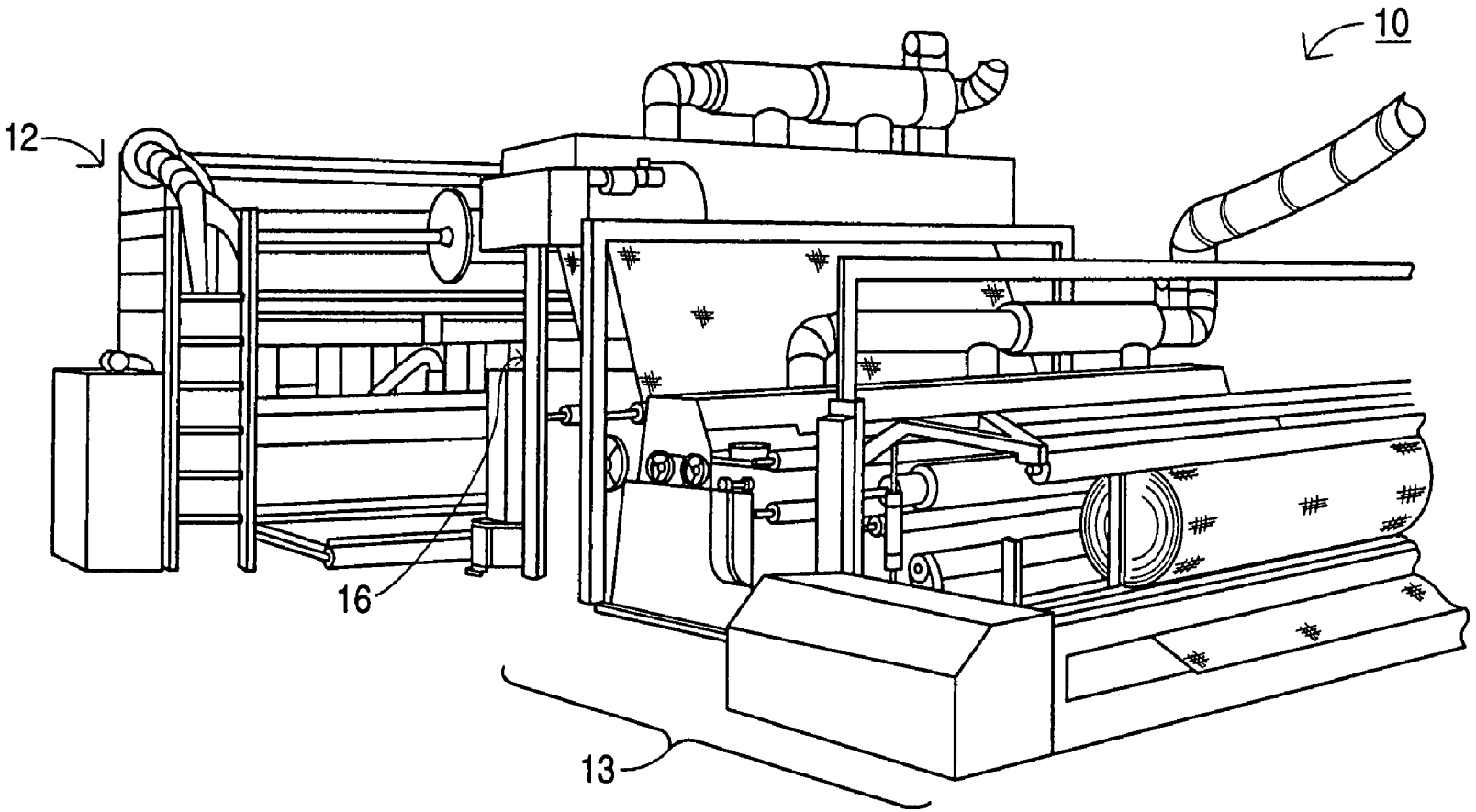
FIG. 1 is a perspective view of a fabric making apparatus constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

The present invention includes a weft-inserted warp knitted fabric having a fabric construction of at least 8 warp yarns to 9 weft yarns (8×9) and a print receptive coating. For use as printed substrates having sufficient printing surface areas, fabric constructions between about 8×9 and 18×18 are suitable. Both warp and weft yarns are synthetic, and polyester is desired because of its durability and handling characteristics. As banners and the like for outdoor advertising or the display of other information are by necessity large, larger one-piece fabric panels are desired. Warp knitting machines known in the art are capable of producing single panels in excess of 72 inches in width and up to about 120 inches in width. Thus, the printing substrate of the present invention is produced in panels at least 72 inches in width.

The print receptive coating of this embodiment of the present invention is desirably polyvinyl chloride (PVC), and preferably a vinyl acrylic blended coating since acrylic provides enhanced printability and durability. Plastisol is one such preferred vinyl acrylic blend with 100% of the coating remaining on the material since it contains no carriers or solvents that must be evaporated or otherwise removed. However, plastisol has not proven satisfactory as a coating on woven fabrics since a slower process speed is required for its satisfactory application. To enhance light transmission through the printing substrate, an opacifier such as titanium oxide may be used in the finishing process. Further, to meet the requirements of current fire protection codes, such large printed substrates must be flame retardant. Thus, depending upon the specific application, a flame retardant is also applied during the finishing process.

Figure 2:
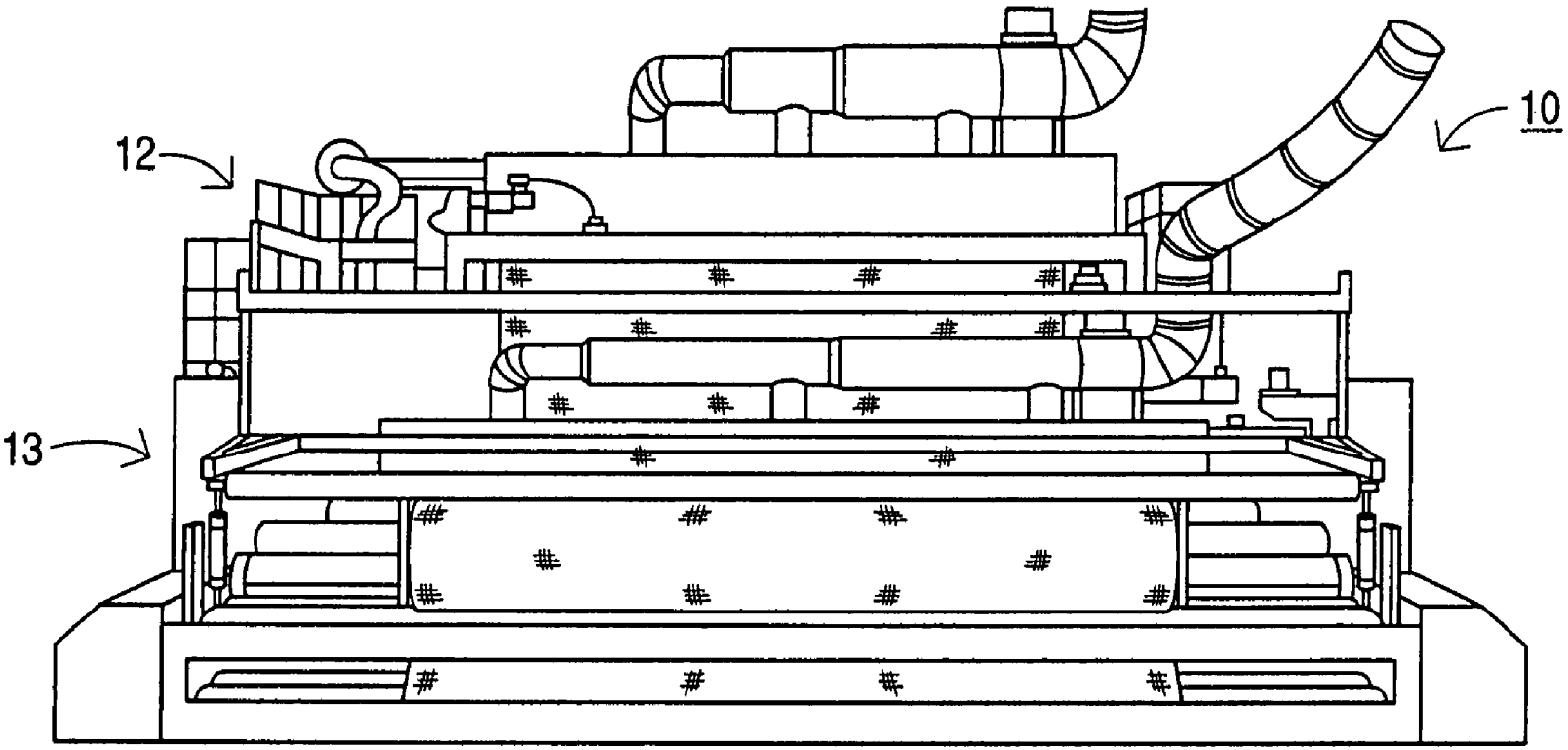
FIG. 2 is a front view of the apparatus shown in FIG. 1.

The present invention provides a weft-inserted warp knitted printing substrate having a print receptive coating that may be manufactured during a single operation without the need for additional moving or handling steps. Such a single fabric forming and coating manufacture is disclosed in previously cited application Ser. No. 09/479,678. As described in that application, an apparatus for forming a fabric web in a single operation includes a fabric web forming station for forming a continuous fabric web and a finishing station downstream of the fabric web forming station for providing treatment to the continuous fabric web. Specifically, as best seen in FIGS. 1 and 2, the fabric making apparatus, generally designated 10, is shown constructed according to the related and present invention. The fabric making apparatus 10 includes three major sub-assemblies: a fabric web station 12; a finishing station 13; and an accumulator 16.

Figure 3A:
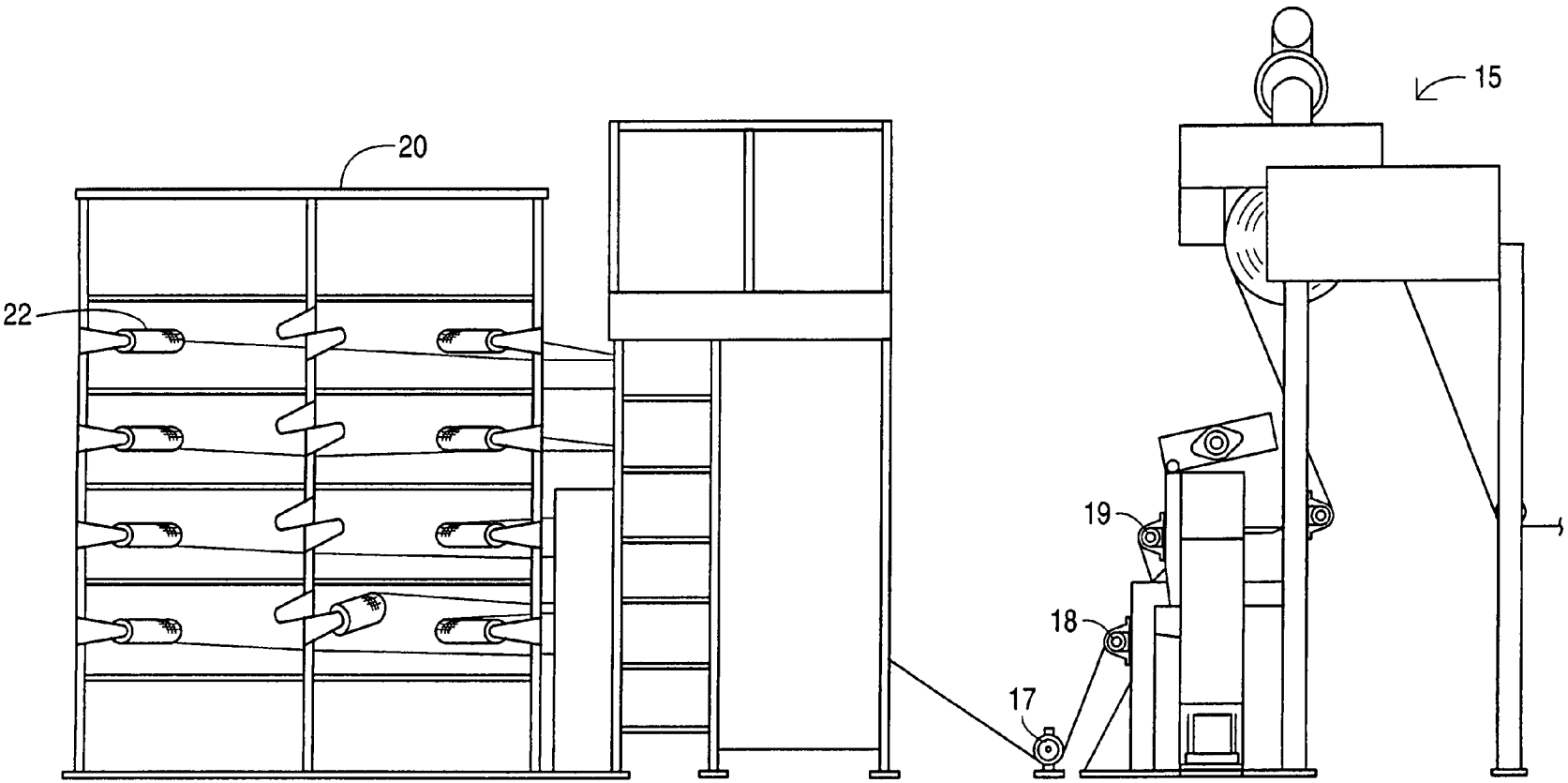
FIGS. 3A and 3B is a side view of the apparatus shown in FIG. 1.
Figure 3B:
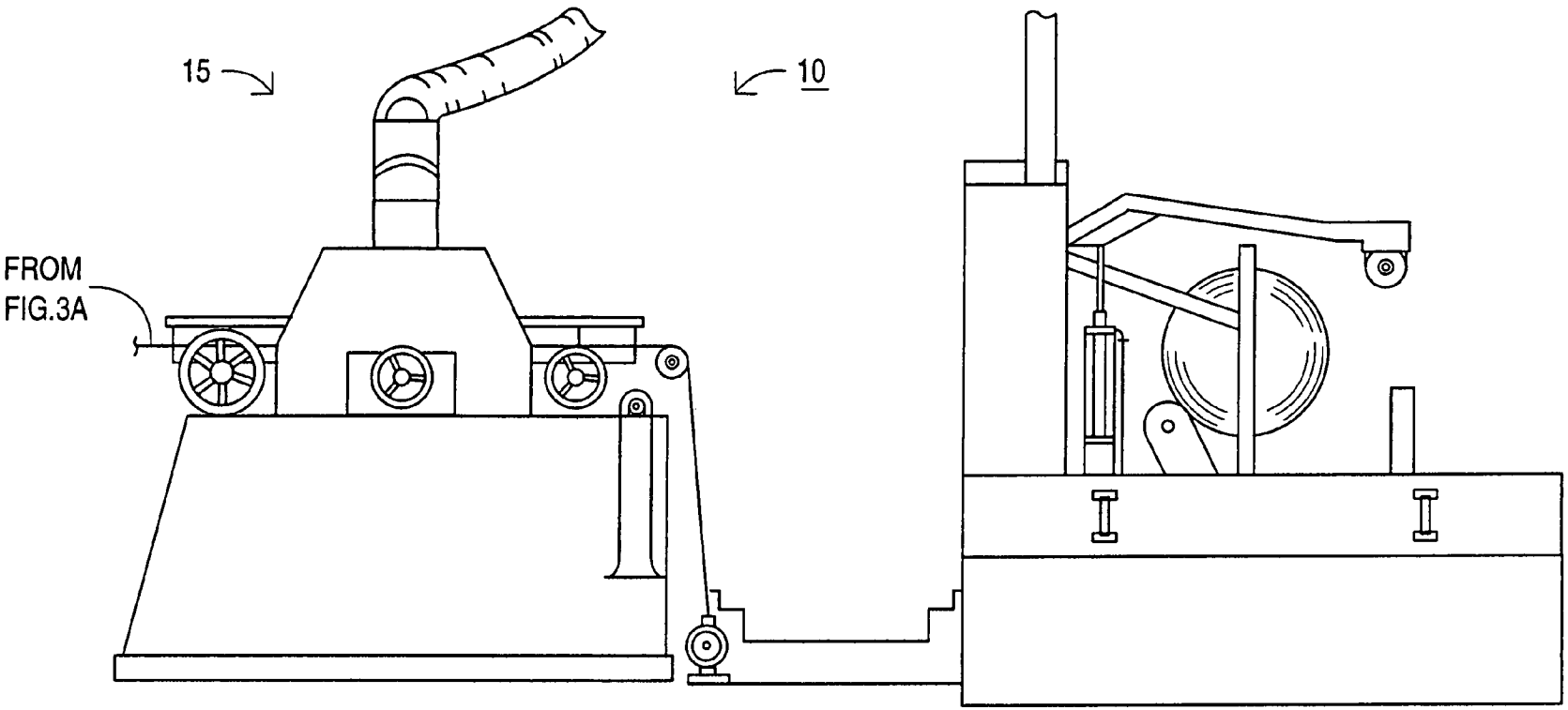

As best seen in FIG. 3, in the preferred embodiment, the fabric web forming station 12 is a warp knitting machine having a creel 20 and a plurality of yarn packages 22 for supplying yarn to the warp knitting machine. One such machine is available from LIBA Maschinenfabrik, Naila of West Germany. This machine is described in part by U.S. Pat. Nos. 4,154,068; 3,724,241; and 3,584,479 which are hereby incorporated by reference in their entirety. As discussed above, while warp knitting machines having widths greater than 72 inches are common and relatively inexpensive, finishing machines having widths greater than 72 inches become exponentially expensive. In addition, the overhead costs associated with moving such large rolls can add substantial cost per yard to the final material. This relationship can be best seen in FIG. 10 in which the fabric finishing costs increase at a much higher rate than the fabric forming costs. In the present invention, forming and finishing costs only increase at a slightly higher rate than forming alone. This may result in cost savings up to 25 cents per square yard.

Figure 4:
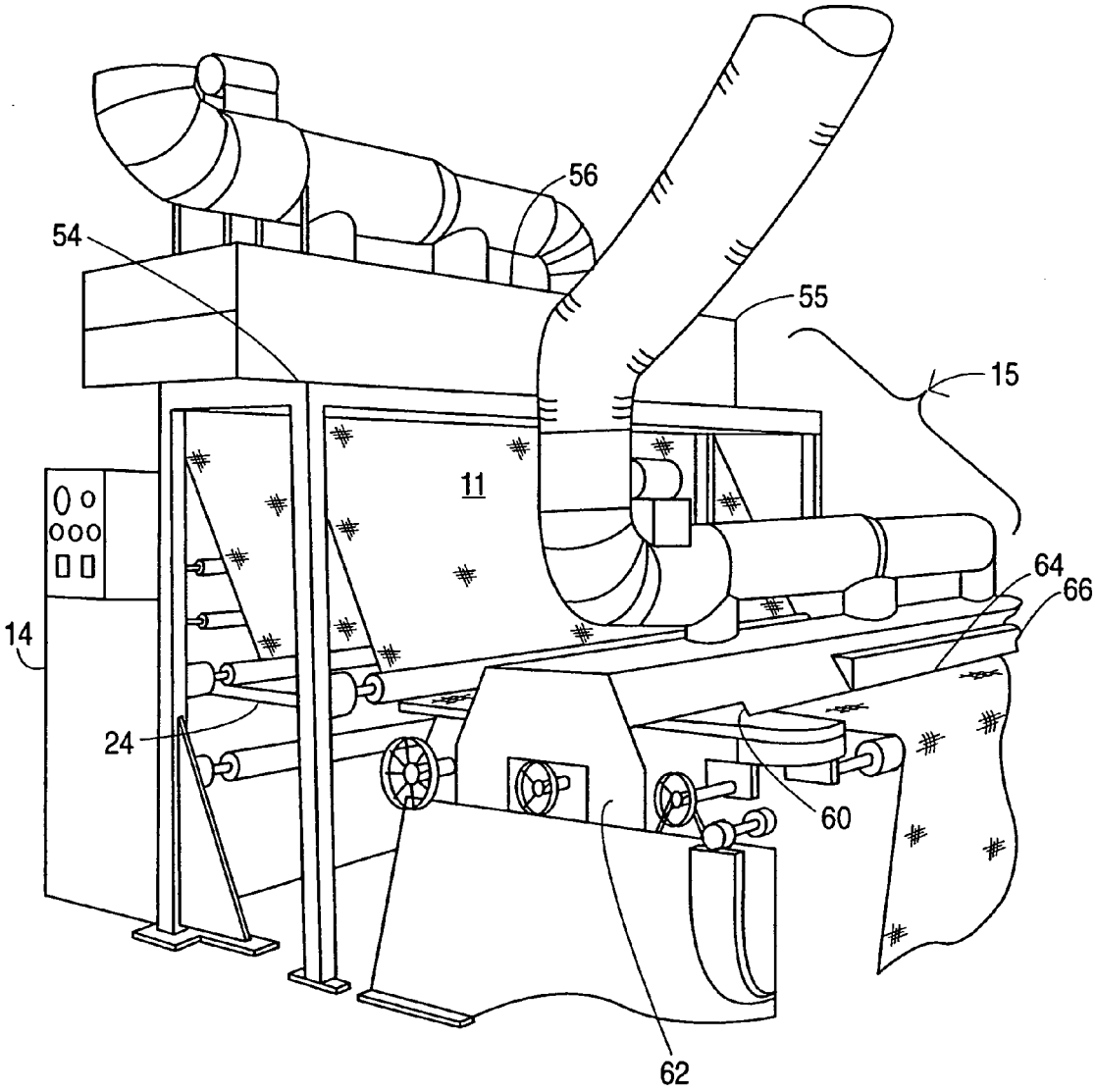
FIG. 4 is an enlarged front perspective view of the finishing station shown in FIG. 3.
Figure 5:
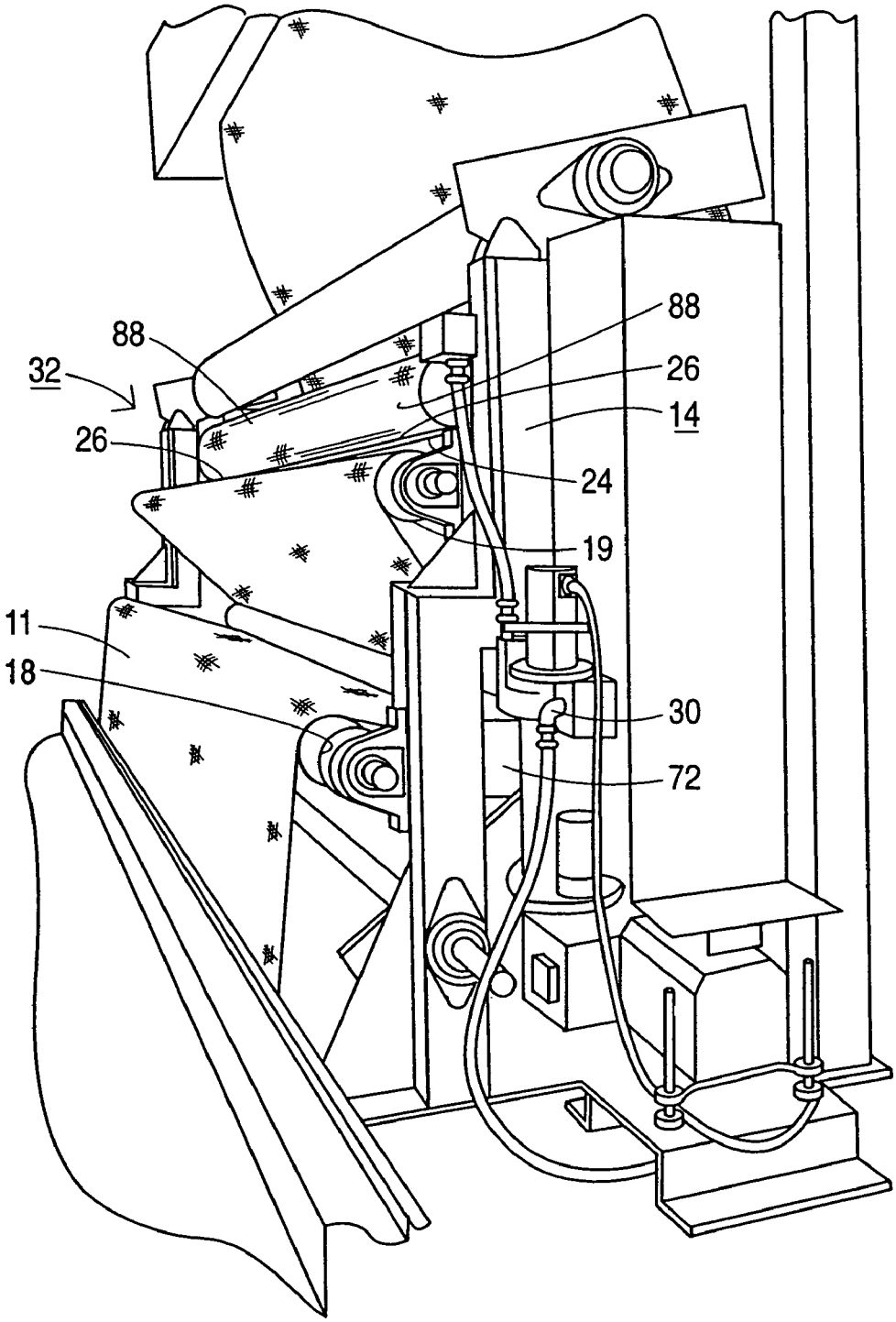
FIG. 5 is an enlarged rear perspective view of the finishing station applicator shown in FIG. 3.
Figure 13:
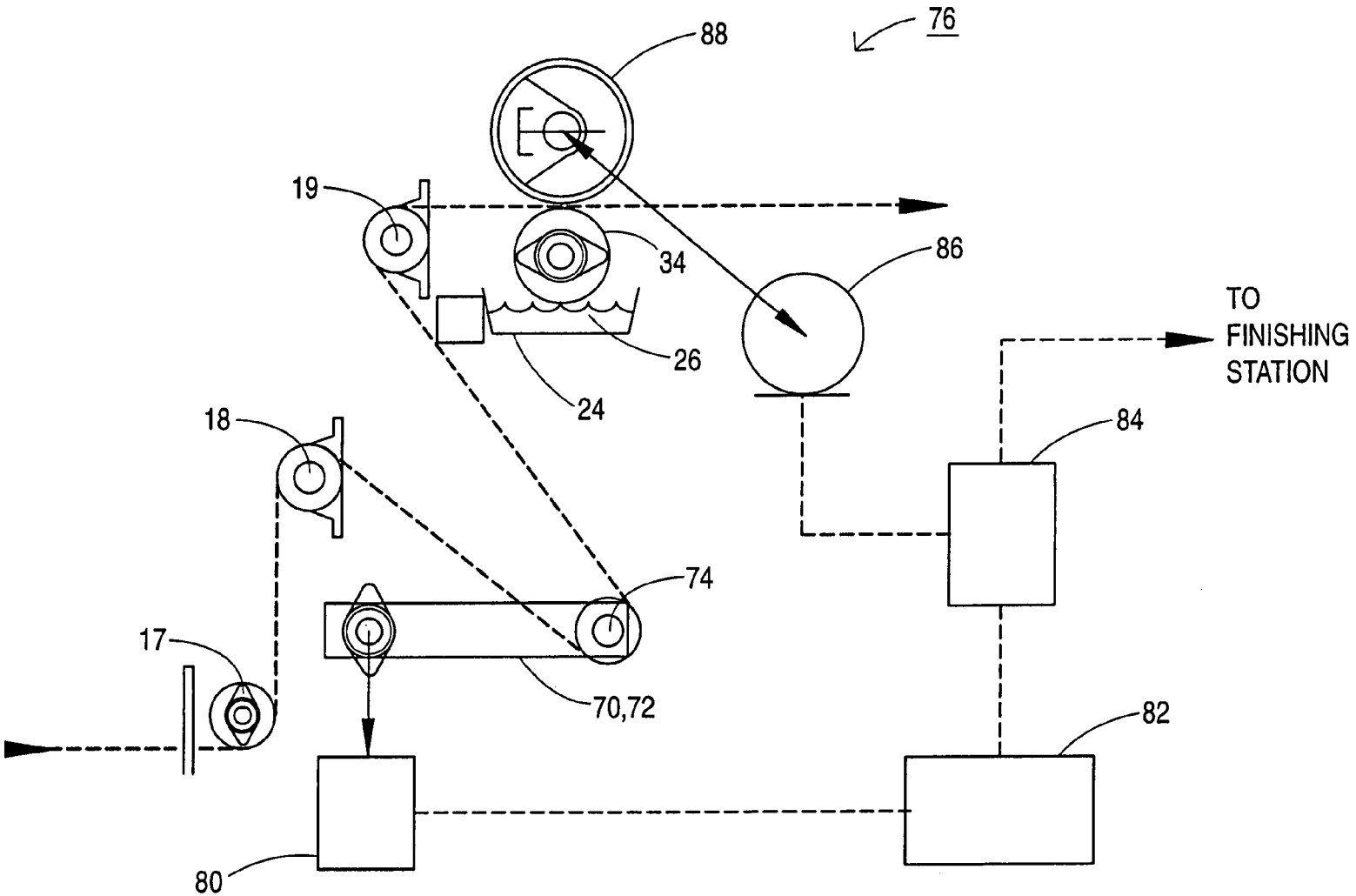
FIG. 13 is a diagram showing how the speed of the finishing station, shown in FIG. 4, is varied.

As seen in FIGS. 3A, 4 and 5, the finishing station 13 includes an applicator 14 and a curing station 15. As best seen in FIG. 13, fabric web 11 exiting the front face of the fabric forming station 12 passes under rollers 17 and 74 and over rollers 18 and 19 before feeding into finishing station 13 where a liquid coating 26 is applied to the fabric web 11 by the substantially excess-free applicator. In the preferred embodiment, the substantially excess-free applicator system includes a knurled roller assembly 32. As best seen in FIGS. 6B, 6C and 7, the knurled roller assembly includes a knurled roller 34 for picking up a liquid coating 26 contained in pan 24 by grooves 35 on the surface of the knurled roller 34 and evenly applied to continuous fabric web 11 passing across the top of the knurled roller 34.

The bulk density of the knurled roller 34 is less than about 3 times greater than the density of the liquid coating 26, thereby providing buoyancy to support the weight of the knurled roller 34. In the preferred embodiment the knurled roller 34 is formed substantially from aluminum; however, the knurled roller 34 could be jacketed with a high-density outer sheath and a low-density inner core. As seen in FIG. 5, a level control system 30 maintains an optimum level of liquid coating 26 in pan 24 such that knurled roller 34 is floatably supported.

Figure 6A:
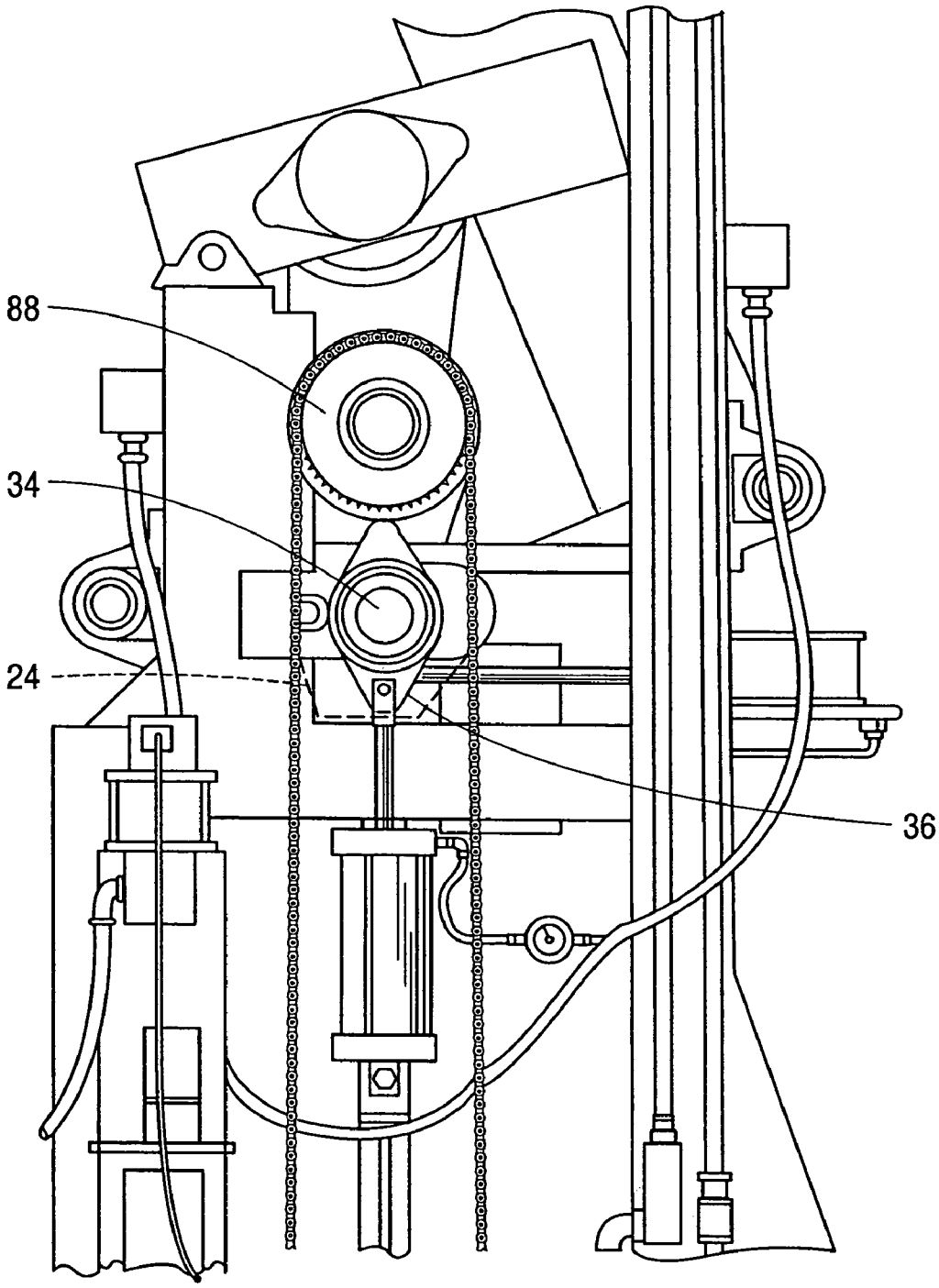
FIG. 6A is an enlarged side view of the finishing station applicator shown in FIG. 3.
Figure 6B:
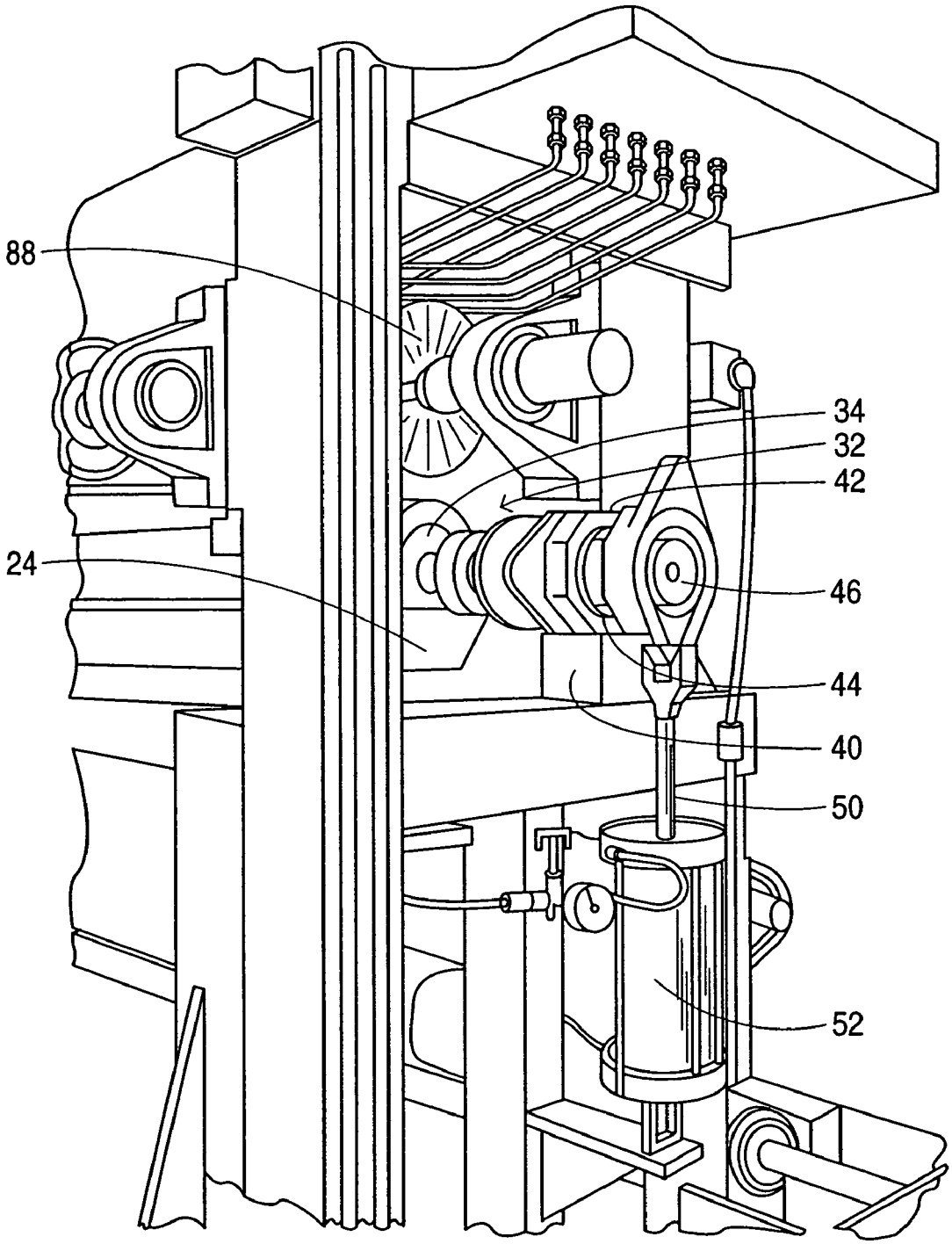
FIG. 6B is an enlarged side view of the opposite end of the finishing station applicator shown in FIG. 6A.
Figure 6C:
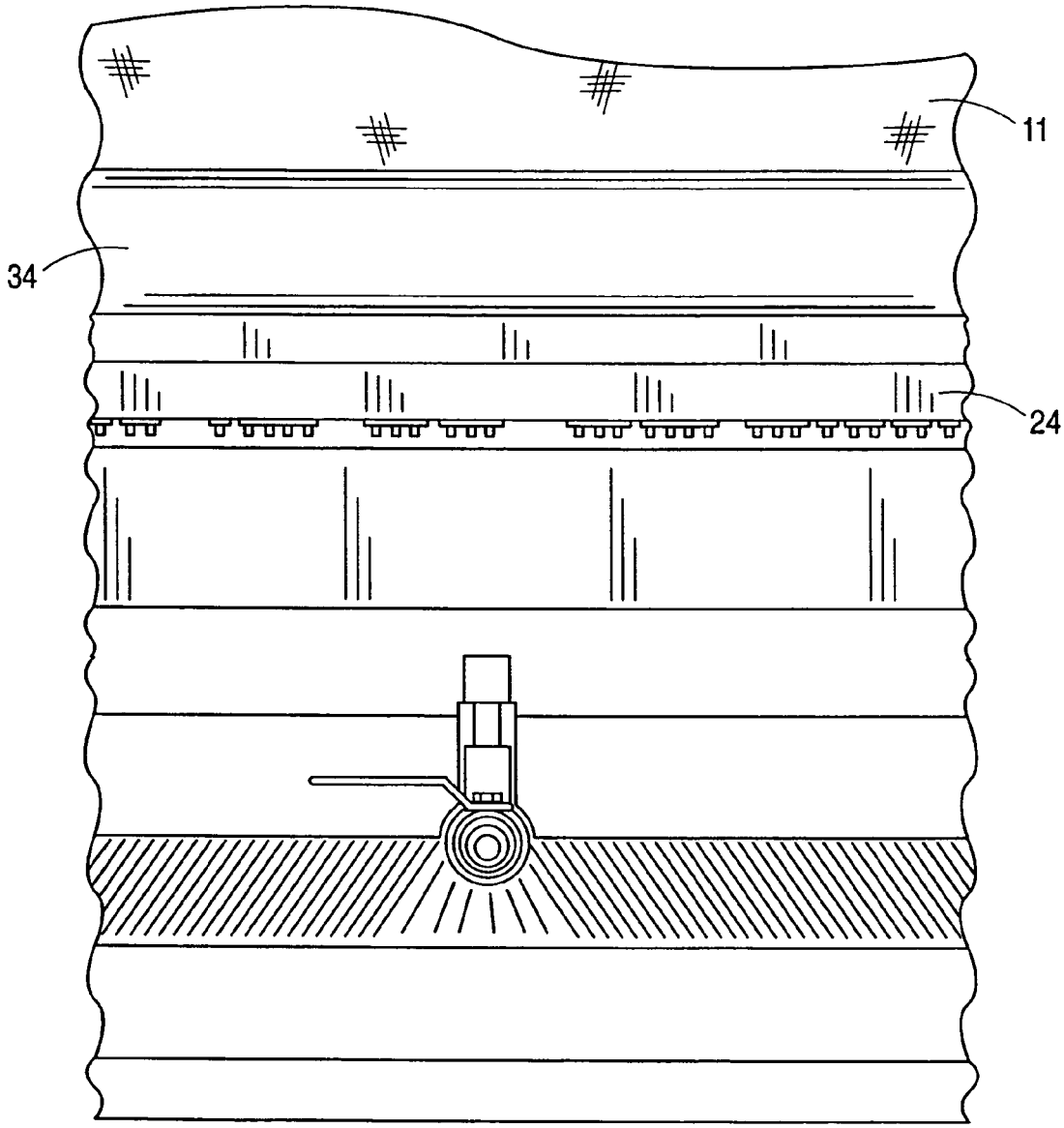
FIG. 6C is an enlarged front view of the finishing station applicator shown in FIG. 6A.
Figure 7:
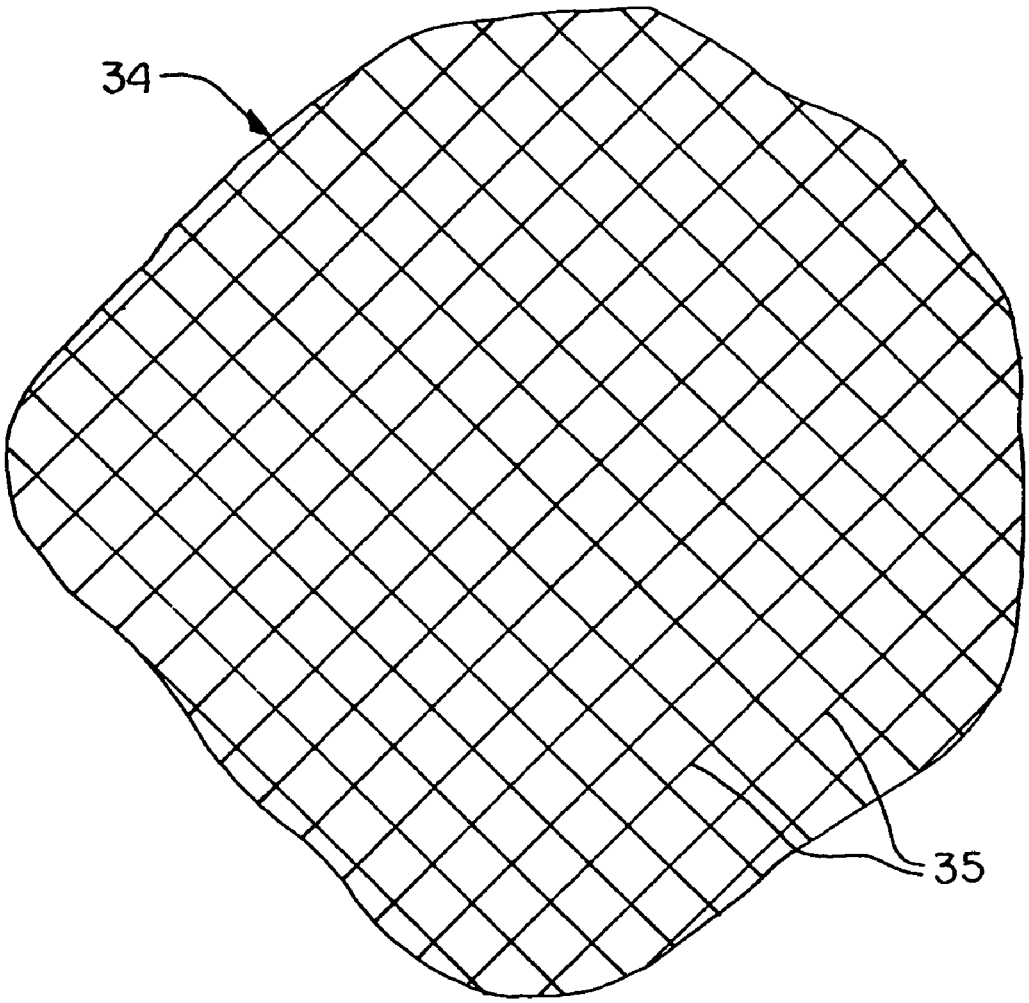
FIG. 7 is a greatly enlarged view of the knurled roller of the finishing station applicator shown in FIG. 6C.

As best seen in FIGS. 6A and 6B, a deflection compensator 36 also is provided to further prevent sagging of knurled roller 34. In the preferred embodiment, the deflection compensator 36 is comprised of a frame 40 which supports a pivotal first bearing 42, a journal 44, and a second bearing 46. A variable linkage 50 is attached to the second bearing 46 to vary the amount of force applied to knurled roller 34. In the preferred embodiment, an actuator 52 replaces or is attached to variable linkage 50.

Figure 11A:
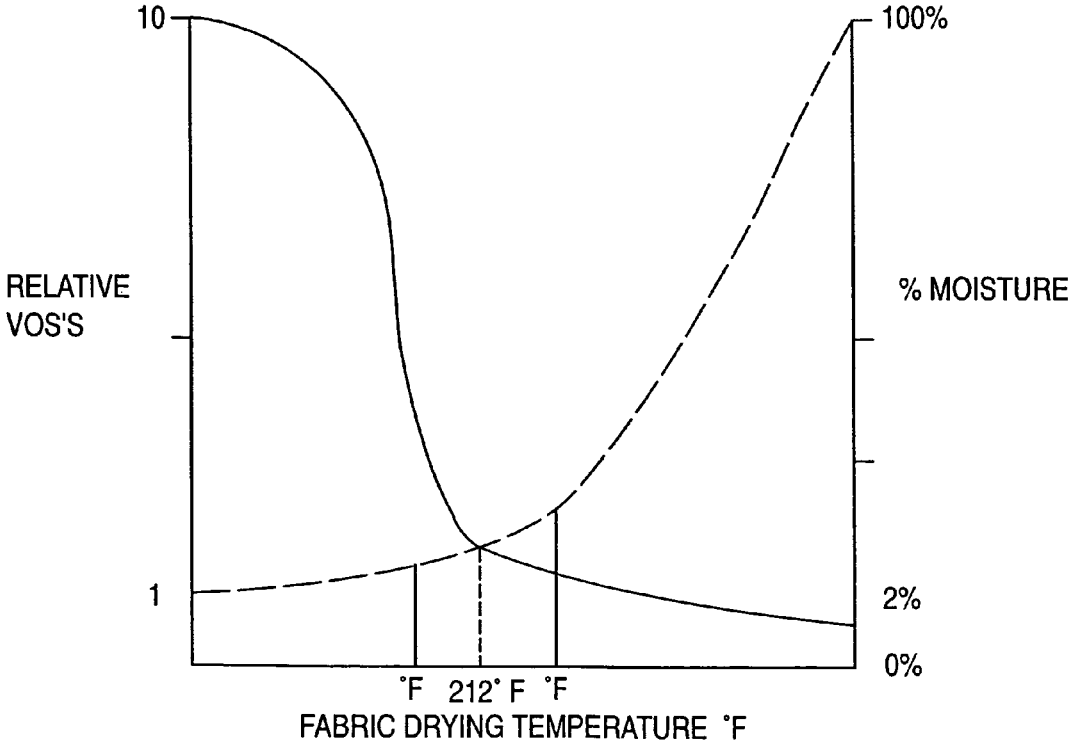
FIG. 11A is a chart showing the relationship between relative VOCs and fabric drying temperature, and between moisture percentage and fabric drying temperature.
Figure 11B:
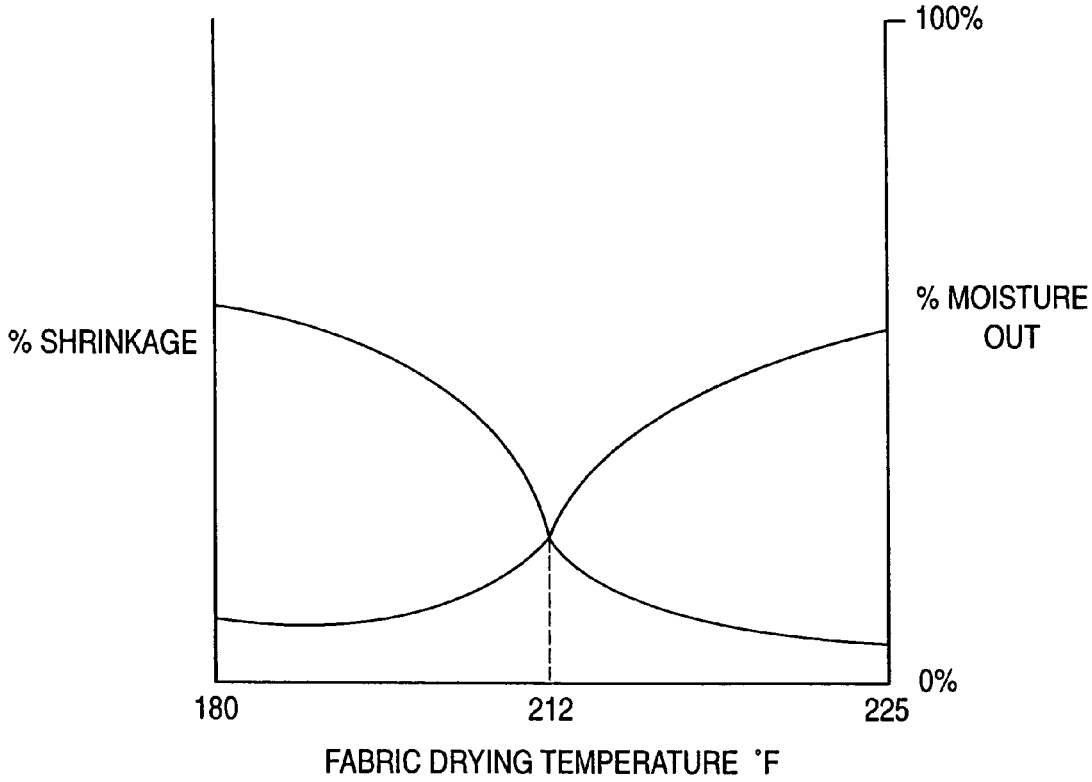
FIG. 11B is a chart showing shrinkage and moisture removed, and the relationship between shrinkage and moisture removal, as fabric drying temperature is varied.

Referring back to FIG. 4, in the preferred embodiment, curing station 15 is comprised of both a drying station 54 and a heat set station 60. The coated continuous fabric web 11 feeds into drying station 54 across heat drum 55 where moisture is substantially removed from the coated fabric. Ambient air is drawn through hood 56 mounted directly above heat drum 55 to aid in the drying process. The heat drum is maintained at a temperature between about 180 F and about 225 F to remove most of the moisture from the coated continuous fabric web but not to produce VOCs which occur during curing of the coating. This relationship can be best seen in FIG. 11A in which the moisture content decreases at a much higher rate than the VOCs emission rate. FIG. 11B shows how a heat drum temperature of approximately 212 F optimizes moisture removal while minimizing shrinkage of the coated fabric.

The air flow velocity of the hood 56 is greater than about 400 CFM/ft of the width of the continuous fabric web 11 which aids in drying the coated continuous fabric web 11. However, since the vapors include little or no VOCs, this large amount of air does not need to be treated further before being discharged into the atmosphere.

Figure 12:
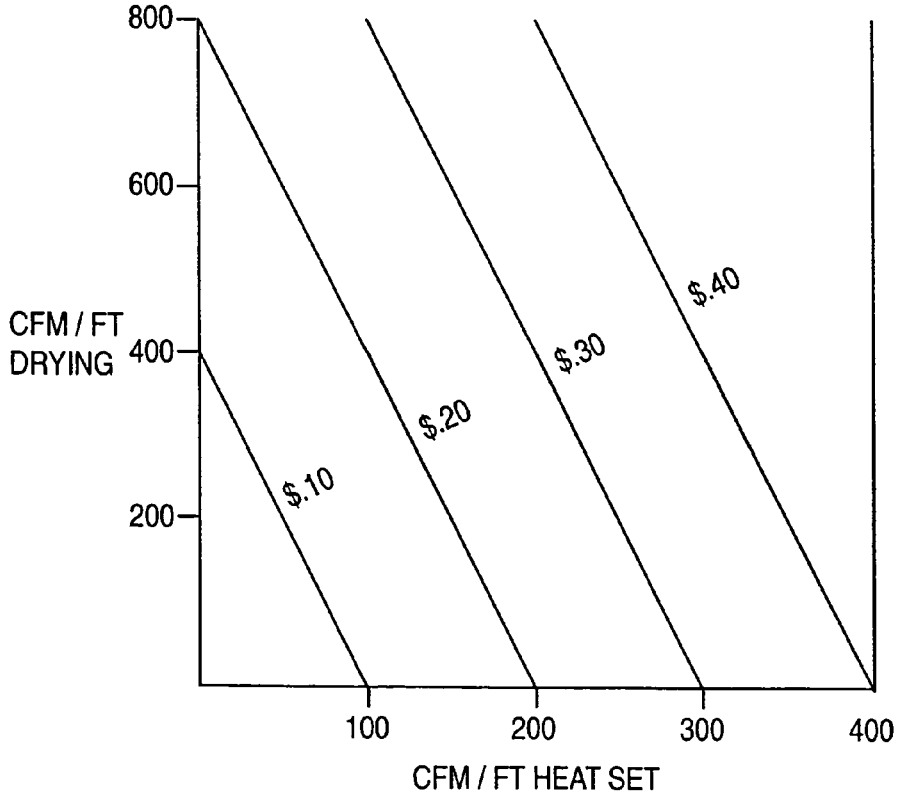
FIG. 12 is a chart showing the relative costs, in dollars, associated with various drying and heat set airflow velocities.

Downstream of heat drum 55, dried fabric web 11 is fed into heat set station 60 where the fabric web 11 passes under heaters 64 for final finishing. In the preferred embodiment, heaters 64 are low-mass infrared lights which quickly cool when turned off. This permits the finishing station 13 to be stopped and started as needed without burning the coated continuous fabric web 11. The heat set station 60 also includes a hood 66 located above the heat set station 60 for removing VOCs driven off from the fabric web 11 by the heat set station 60. Unlike the drying station 54, the airflow velocity of the hood is less than about 100 CFM/ft of the width of the continuous fabric web. This is a much smaller amount of air to be treated before being discharged into the atmosphere and results in substantial cost savings. This relationship can be best seen in FIG. 12 in which the relative process costs on a 1 to 5 scale are shown as a function of drying and heat set CFM rates per foot of fabric web. In the present invention, being able to use low CFM rates for heat setting keeps the total curing station cost low.

In the preferred embodiment, the heat set station 60 further includes a tenter frame 62 for heat setting the continuous fabric web 11 to a predetermined width. One such machine is available from Marshall & Williams Company of Greenville, S.C. This machine is described in part by U.S. Pat. No. 3,179,975 which is hereby incorporated by reference in its entirety. The fabric is then taken up on a conventional take-up unit such as that manufactured by Greenville Machinery Corporation of Greenville, S.C.

Figure 8:
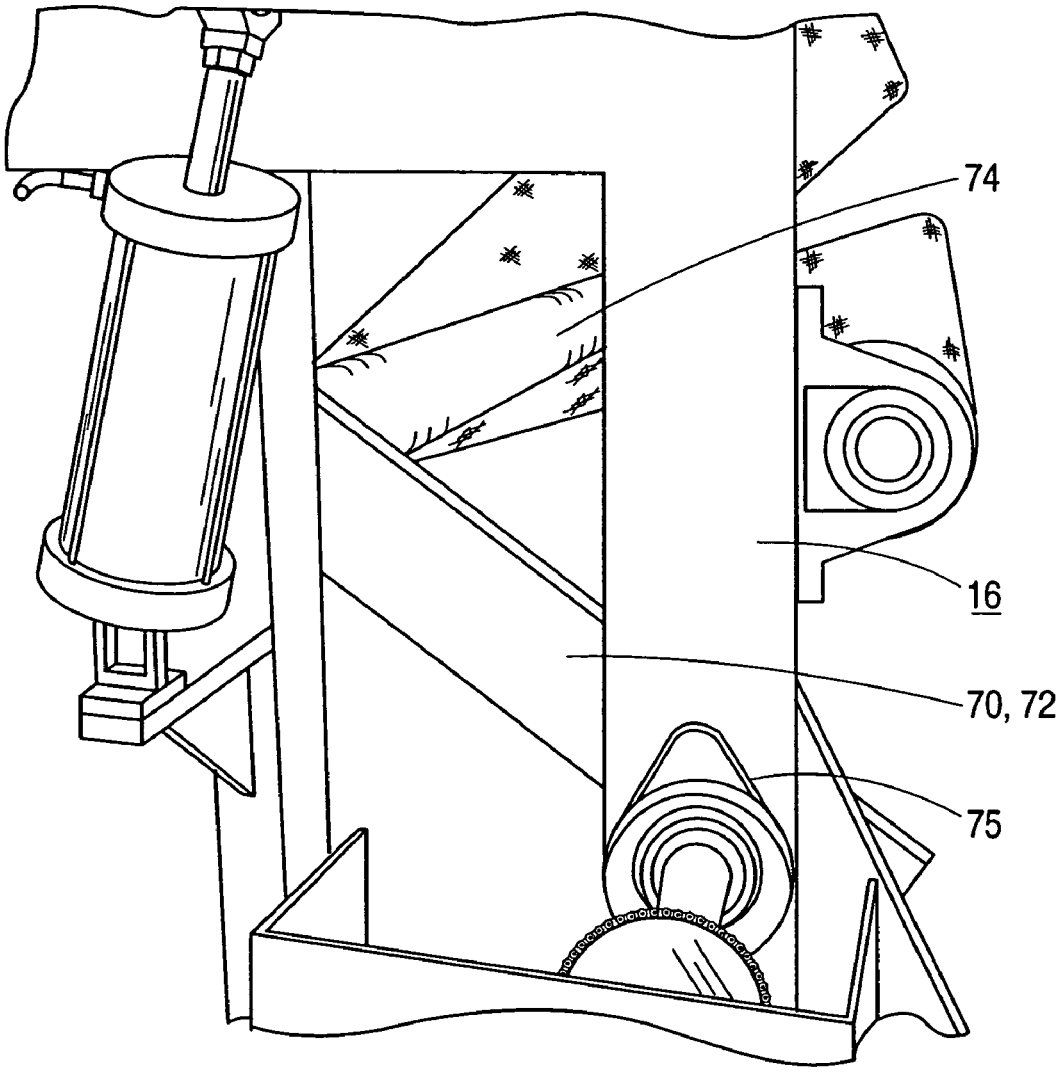
FIG. 8 is an enlarged side view of the accumulator shown in FIG. 3.
Figure 9:
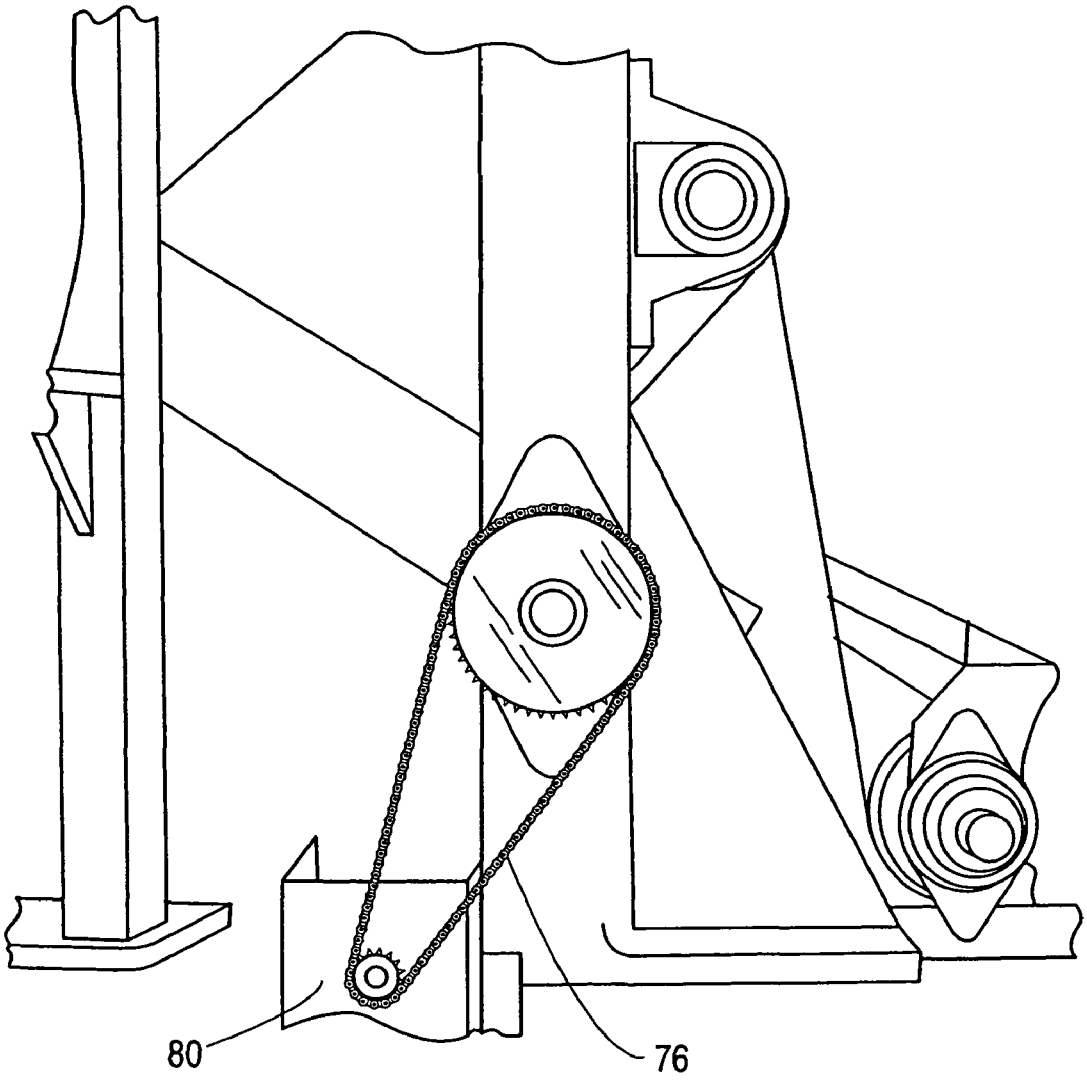
FIG. 9 is an enlarged side view of the control system for accumulator shown in FIG. 8.

In the preferred embodiment, the present invention also provides a fabric web reserve between the fabric making station 12 and the finishing station 13. As seen in FIGS. 8 and 9, accumulator 16 includes a biased roller 74 which is supported by two arms 70, 72 on a frame 75. A control system 76 includes a position sensor 80 for varying the speed of electric motor 86 and the finishing station 13 in response to the position of the accumulator arms 70, 72. As best seen in FIG. 13, position sensor 80 senses the relative position of accumulator arms 70, 72 and provides an input to a microprocessor 82. Microprocessor 82 provides an output signal to a DC electric voltage controller 84 which varies the speed of electric motor 86 and the finishing station 13. Electric motor 86 is coupled to and turns pulling roller 88. The lower the position of accumulator arms 70, 72, the higher the speed of electric motor 86. Conversely, as arms 70, 72 rise, the speed of electric motor 86 is reduced.

In operation, the fabric web 11 is formed by the warp-knitting machine 12 and passes to the finishing station 13. Fabric web 11 exiting the front face of the fabric forming station 12 passes under rollers 17 and 74 and over rollers 18 and 19 before feeding into finishing station 13 where the liquid coating 26 is applied to the fabric web 11 by the substantially excess-free applicator and knurled roller assembly 32. Level control system 30 maintains an optimum level of liquid coating 26 in pan 24 such that knurled roller 34 is floatably supported and deflection compensator 36 also further prevent sagging of knurled roller 34.

A fabric web reserve is provided between the fabric making station 12 and the finishing station 13 by accumulator 16. Control system 76 varies the speed of electric motor 86 and finishing station 13 in response to the position of the accumulator arms 70, 72.

The coated continuous fabric web 11 then feeds into drying station 54 across heat drum 55 where moisture is substantially removed from the coated fabric. Ambient air is drawn through hood 56 mounted directly above heat drum 55 to aid in the drying process.

Downstream of heat drum 55, the dried fabric web 11 is fed into heat set station 60 where the fabric web 11 passes under heaters 64 for final finishing by the tenter frame 62 for heat setting the continuous fabric web 11 to a predetermined width.

Figure 10:
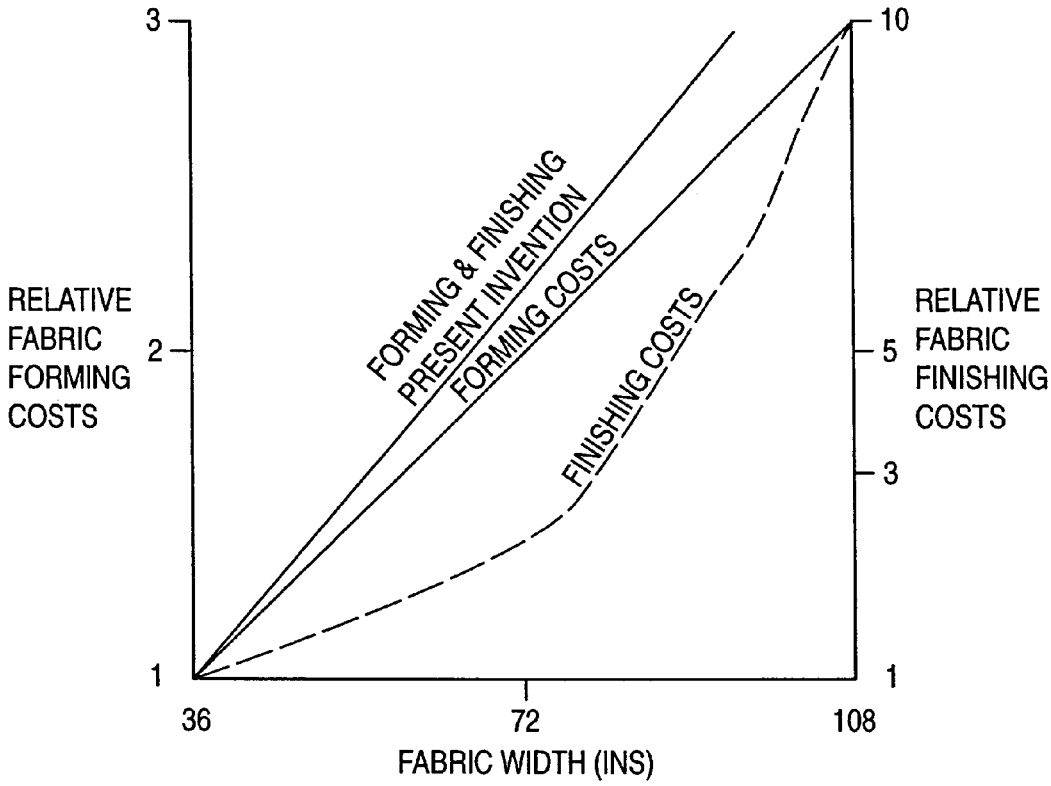
FIG. 10 is a chart showing the relationship between relative fabric forming costs and fabric width.

The present invention is able to use relatively common warp knitting machines having widths greater than 72 inches without the need for very expensive finishing machines having widths greater than 72 inches. In addition, the overhead costs associated with moving such large rolls are substantially reduced as shown in FIG. 10 in which the fabric finishing costs increase at a much higher rate than the fabric forming costs. Specifically, in the present invention, forming and finishing costs only increase at a slightly higher rate than forming alone thereby resulting in cost savings up to 25 cents per square yard.

In addition, the present invention provides a measurably superior coated fabric web when compared to a standard tenter frame coated fabric web in which the fabric web is separately formed and then finished on the tenter frame and to a conventional high speed finishing, tenter frame system. Samples of all three processes were tested for yarn uniformity in the warp and weft directions shown in Table 1.

TABLE 1

| | WARP DIRECTION | | | WEFT DIRECTION | | |
|---|---|---|---|---|---|---|
| PROCESS | Spacing | SD | % Var | Spacing | SD | % Var |
| Present Invention | 2.03 mm | 0.05 | 3 | 1.77 mm | 0.08 | 5 |
| Tenter Frame (I) | 2.04 mm | 0.12 | 6 | 1.82 mm | 0.30 | 16 |
| Tenter Frame (II) | too curvy to measure | | | too curvy to measure | | |

As can be seen, the tenter frame standard deviation is between about 2¼ and 4 times greater than that of the present invention. The high speed finishing, tenter frame system was so curvy as not to be meaningfully measurable. Handling alone appears to be the cause of the tenter frame variability. However, speed appears to be a major contributor for the high speed finishing, tenter frame system process. Specifically, the present invention operates between about 1 and 4 yards per minute and preferably at about 3 yards per minute. In contrast, the high speed process operates at about 90 yards per minute. Accordingly, the present invention avoids both of these problems and produces a continuous fabric web finished in a single operation which is substantially distortion free. Specifically, the variation in the warp direction of the finished fabric web is less than about 3% (0.05 SD (standard deviation)/2.03) and the variation in the weft direction of the finished fabric web is less than about 5% (0.08 SD/1.77).

Thus, the present invention is able to produce a continuous fabric web finished in a single operation is which the finished fabric web is substantially distortion free. Compared to the prior art, the variation in the warp direction of the finished fabric web is less than about 6% and, preferably, less than about 3%. In addition, the variation in the weft direction of the finished fabric web is less than about 16% and, preferable, less than about 5%.

In the preferred embodiment, the finished fabric web is a warp knit fabric and, preferable, is a weft inserted, warp knit fabric. The finished fabric web is formed from synthetic yarn which, unlike fiberglass-type yarns, are much more difficult to stabilize. Preferably, the finished fabric web is formed from polyester yarn.

The present invention is thus able to produce a finished fabric web greater than about 72 inches wide and, preferably, greater than about 96 inches wide or greater than about 120 inches wide depending on the width of the knitting machine.

A weft-inserted, warp knit printing substrate constructed according to the present invention is formed in a single operation as a 9×18 construction (9 yarns in the warp to 18 yarns in the weft); however, fabric constructions between about 8×9 and 18×18 are satisfactory for such purpose. As described in pending application Ser. No. 09/479,678, fabric webs of greater than about 120 inches may be formed and treated on a single apparatus without the need for moving and handling to other stations. Such a single operation provides a fabric construction that is substantially distortion free, and hence, superior for use as a printing substrate. Desirably, yarn uniformity in the warp direction is less than about 3% and less than about 5% in the weft direction.

Figure 14:
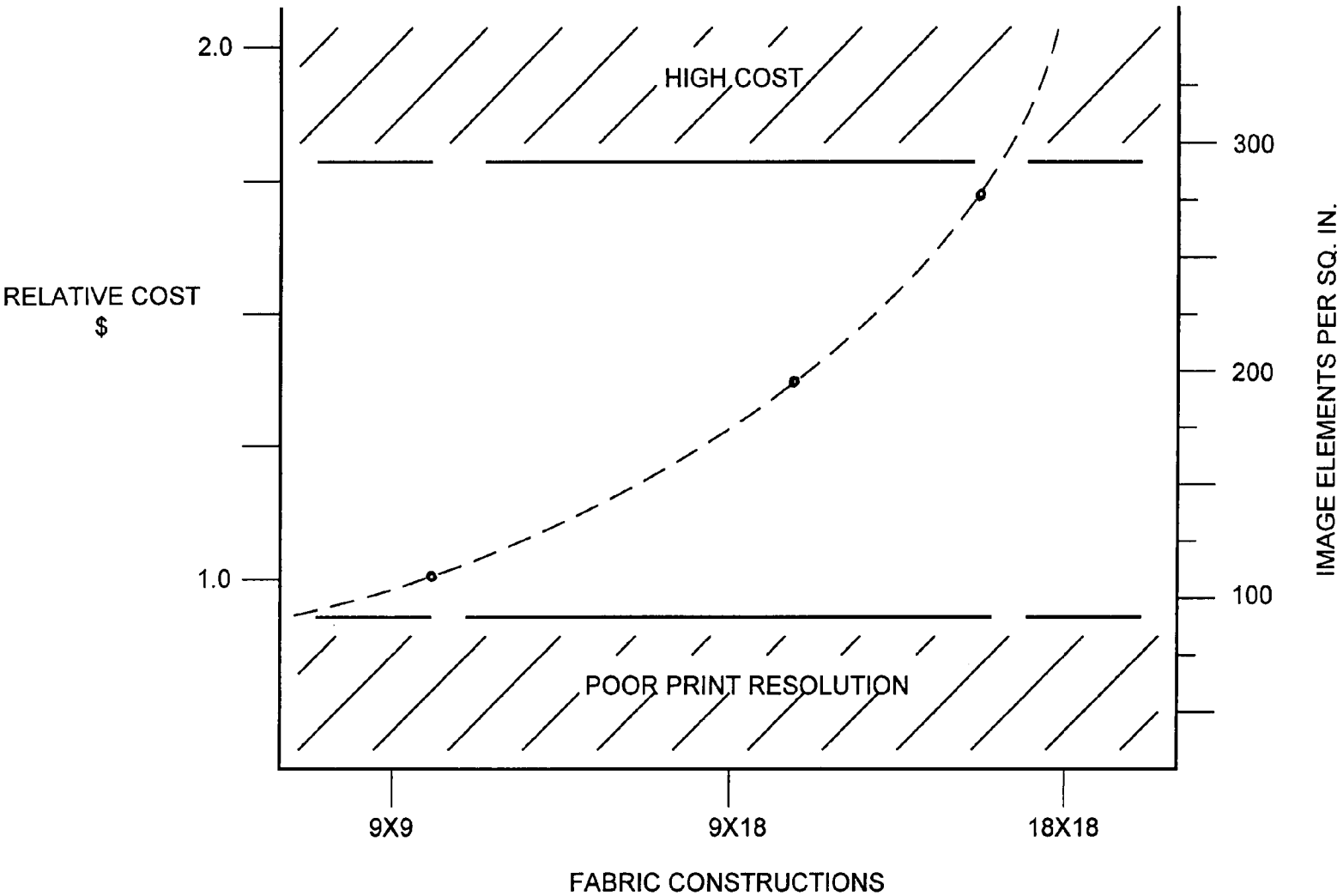
FIG. 14 is a graph illustrating the relative costs, in dollars, associated with the preferred ranges of warp knitted constructions in comparison with the print resolution which may be obtained for each construction, illustrating the balance between cost and print resolution achieved by the present invention.

For printed substrate construction, both warp and weft yarns are polyester with deniers between about 500 d and 1000 d. As best illustrated in FIG. 14, a graph is shown that illustrates the relative costs, in dollars, associated with the preferred ranges of warp knitted constructions in comparison with the print resolution, which may be obtained for each construction. As can be seen, the present invention achieves a balance between cost and print resolution FIG. 14 demonstrates that a fabric construction of at least about 8×9 is required to provide sufficient print area for good print resolution, but that a fabric construction greater than about 18×18 will not be economical. Since fabric cost increases linearly as surface coverage increases geometrically, there is a substantial economical advantage due to increasing surface coverage per unit fabric web cost.

In addition, for large signage intended for outdoor use, the printing substrate must be sufficiently perforate to withstand wind loading and to permit adequate airflow. Fabric constructions greater than about 18×18 may be too tightly formed to provide sufficient permeability for air passage therethrough.

After formation of the weft-inserted, warp knit fabric, a print receptive coating, desirably polyvinyl chloride (PVC), is applied to the knitted fabric. In the preferred embodiment, the knurled roller applicator described in application Ser. No. 09/479,678 is replaced with a smooth roll for applying the print receptive plastisol for the plastisol viscosity preferably used and for the desired % add-on.

For enhanced durability and printability, a vinyl acrylic blend such as plastisol is applied. While not suitable for higher speed processes, plastisol is a superior coating for lower speed fabric producing and treating machines such as that described in pending application Ser. No. 09/479,678. A distinct advantage of plastisol is that substantially 100% of the coating remains on the fabric since solvents or other carriers are not required. Thus, such a coating can be applied with greater safety during manufacture and without emissions due to evaporation or removal of carriers. For applications involving signage, an opacifier such as titanium dioxide is applied during the finishing process to enhance light transmissibility, and a flame retardant such as aluminum trihydrate is applied to meet fire code requirements for large printed media.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A method for forming and finishing a continuous fabric web in a single operation to produce a printing substrate, said method comprising the steps of:

(a) forming a continuous warp knit fabric web at a fabric web forming station;

(b) receiving said continuous fabric web directly from said fabric web forming station and providing a finishing treatment to said continuous fabric web at a finishing station, said finishing station including: an applicator having (i) a liquid, print receptive coating supply; (ii) an elongated pan extending across the width of said fabric web for containing said liquid coating; and (iii) an elongated knurled roller positioned in said pan in direct contact with said liquid coating and in direct contact with the bottom surface of said fabric web, whereby the rotation of said knurled roller transfers a predetermined amount of said liquid coating to said fabric web, thereby forming a printing substrate having a single fabric layer; and (c) printing directly onto said printing substrate.

2. A method for forming and finishing a continuous fabric web in a single operation to produce a printing substrate, said method comprising the steps of:

(a) forming a continuous knit fabric web at a fabric web forming station;

(b) receiving said continuous fabric web directly from said fabric web forming station and providing a finishing treatment to said continuous fabric web at a finishing station, said finishing station including: an applicator having (i) a liquid, print receptive coating supply; (ii) an elongated pan extending across the width of said fabric web for containing said liquid coating; and (iii) an elongated knurled roller positioned in said pan in direct contact with said liquid coating and in direct contact with the bottom surface of said fabric web, whereby the rotation of said knurled roller transfers a predetermined amount of said liquid coating to said fabric web, thereby forming a printing substrate having a single fabric layer;

(c) providing a fabric web reserve between said fabric web forming station and said finishing station; and (d) printing directly onto said printing substrate.

3. A method of forming and finishing a printing substrate in a single operation comprising:

(a) knitting a weft inserted, warp knit fabric web having at least an 8×9 construction during said single operation;

(b) applying a print receptive coating to said fabric web during said single operation, thereby forming a printing substrate having a single fabric layer; and (c) printing directly onto said printing substrate.

4. The method according to claim 3 further including accumulating said printing substrate prior to applying said print receptive coating.

5. The method according to claim 3 further including applying a flame retardant to the printing substrate during said single operation.

* * * * *